United States Patent [19]

Collier

[11] 4,101,187

[45] Jul. 18, 1978

[54] SOCKET FOR WEDGE BASE BULBS

[76] Inventor: Ben C. Collier, 6121 S. Monticello Dr., Montgomery, Ala. 36109

[21] Appl. No.: 811,871

[22] Filed: Jun. 30, 1977

[51] Int. Cl.[2] ..... H01R 33/06

[52] U.S. Cl. ..... 339/59 L; 339/64 R; 339/176 L

[58] Field of Search ..... 339/59 L, 61 L, 91 L, 339/93 L, 176 L, 208, 210 R, 210 T, 64 R

[56] References Cited

U.S. PATENT DOCUMENTS

| | | | |
|---|---|---|---|
| 3,609,645 | 9/1971 | Turner | 339/176 L |
| 3,955,872 | 5/1976 | Brudy | 339/93 L |

*Primary Examiner*—Neil Abrams

*Attorney, Agent, or Firm*—Roylance, Abrams, Berdo & Farley

[57] ABSTRACT

A socket includes two hingedly connected integrally molded halves, each having a recess extending therethrough so that when the halves are hinged closed the recesses form a through-channel to enclose a pair of U-shaped contact members having wires attached. Posts in the recess in one half position the contacts, keep them separated from each other, and provide an abutment surface to hold them in place when the bulb is inserted into one end of the channel. Mating latch members on the outside of the socket keep it closed.

2 Claims, 8 Drawing Figures

SOCKET FOR WEDGE BASE BULBS

This invention relates to bulb sockets and, more specifically, to an improved socket for receiving a wedge base bulb.

BACKGROUND OF THE INVENTION

Lamp bulbs of the type commonly known as wedge base bulbs are in wide use in many environments including in automobiles wherein they are used for panel lighting and for other purposes. Wedge base bulbs have a glass envelope containing the filament with the base of the envelope itself being designed to be wedged into a receiving socket. Of particular significance is the fact that such bulbs do not have a metallic base like many other forms of lamps. Instead, the connections to the internal filament are made through conductors which extend through the base end of the envelope and are bent backwards over the exterior surface of the wedge base thereof. Electrical energy is then supplied to the bulb by bringing contact elements into engagement with those conductors in various ways.

Wedge base bulbs and bulbs of similar types and sockets for use therewith are shown in a number of issued U.S. Pat. Nos. including 3,143,301; 3,208,032; 3,253,249; 3,339,172; and 3,617,984.

The wedge base bulb has many advantages over screw and bayonet base bulbs, including lower costs for the bulb and the socket to receive it, and increased reliability, both as to the bulb itself and also as to the use of the bulb. For example, the probability of a screw base bulb working itself loose as a result of vibration in an automobile is somewhat greater than with either a bayonet base type or a wedge base type, and bayonet bases tend to corrode in their sockets, rendering replacement more difficult.

Thus, there is considerable increased interest in wedge base bulbs and attention has turned to developing inexpensive and reliable sockets for them. One such approach which has been used is to fabricate leaf type contact elements to engage the conductors of the bulb and to then mold a non-rigid material around the contacts to form the socket into which the bulb can be inserted. The outside configuration of the socket is typically designed to snap into a mounting hole. Experience has shown that there are several difficulties with this approach. For one, the mounting holes formed in an automobile body commonly have sharp edges which can easily slice through the relatively soft non-rigid material, seriously damaging the socket. However, it is not possible to simply make the material harder and more rigid because the socket must be sufficiently resilient to permit insertion of the bulb without excessive force and to press the molded-in contact members against the bulb conductors. Such sockets for use in automobiles must meet rather rigid SAE specifications as to insertion force, etc.

An additional problem with molded-in contacts is the difficulty of keeping the contact surfaces of the molded-in contacts free of the socket material which, of course, is an electrical insulator. Even a small amount of material on that surface renders the socket inoperative.

Still further, the sockets with molded-in contacts involve costly manufacturing processes involving the loading of the electrical contacts into the mold cavities, and there is substantial difficulty in maintaining dimensional characteristics due to the soft molding material.

In addition, it is not presently possible to make a flexible socket with thermoforming materials which can withstand temperatures exceeding about 125° F. (52° C.).

Attempts to overcome these problems have resulted in the use of contact members which snap into pre-molded sockets. However, these efforts have not been fully successful and have resulted in sockets with exposed terminals, light leaks through the rear ends of the sockets, high molding costs as a result of complex molds with slides, cams and the like, or terminals which fail to lock properly and securely into the pre-molded housings.

BRIEF DESCRIPTION OF THE INVENTION

Accordingly, it is an object of the present invention to provide an improved socket for a wedge-base bulb which can be formed using a rigid material which can be inserted into mounting holes without damage or difficulty and which is capable of withstanding relatively high temperatures, e.g., over 400° F. (205° C.).

A further object is to provide such a socket which can be molded in a simple open-close mold and which receives pre-assembled wire and contact assemblies, thereby eliminating any possibility of molding material existing between the bulb conductors and the contacts.

Yet another object is to provide such a socket which is compact and fits into minimum space requirements, which completely encloses and insulates the electrical terminals, and which can be opened easily for inspection or servicing of the contacts.

A still further object is to provide a socket which can receive preassembled contacts and retain them in a "floating" fashion so that no stress is exerted on the contacts and so that the configuration thereof, and the initial insertion force characteristics thereof, are reliably predictable.

Briefly described, the invention includes a socket for releasably receiving a wedge base bulb of the type having an envelope and a pair of exposed conductors on the exterior of the base thereof, and for releasably receiving preassembled conductive wire and clip means for engaging said conductors, said socket comprising first and second socket halves molded from a relatively rigid polymeric material, a hinge member integrally formed with said socket halves and interconnecting said halves so that they can be relatively moved between an open position and a closed position, each of said halves having means defining a recess extending between opposite ends thereof so that, when said halves are moved to said closed position, said recesses form a panel through the socket, one end of said channel being dimensioned to enclose said clip means and to receive the base of said bulb, one of said halves having means at the other end of said channel for receiving a pair of wires and for maintaining said wires in spaced relationship, said one of said halves having means in said recess intermediate the ends of said channel and extending toward the other one of said halves for maintaining said clip means in spaced relationship and in proper position when a bulb is inserted into said one end of said channel to engage said clips, and latch means integrally formed on said halves for retaining said halves in said closed position.

In order that the manner in which the foregoing and other objects are attained in accordance with the invention can be understood in detail, a particularly advantageous embodiment thereof will be described with reference to the accompanying drawings, which form a part of this specification and wherein.

DETAILED DESCRIPTION OF THE INVENTION

Figure 1:
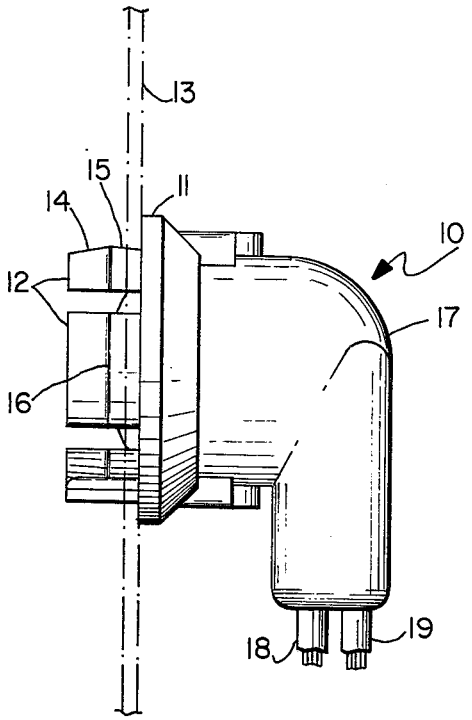
FIG. 1 is a side elevation of a socket according to the invention in its closed assembled condition.
Figure 2:
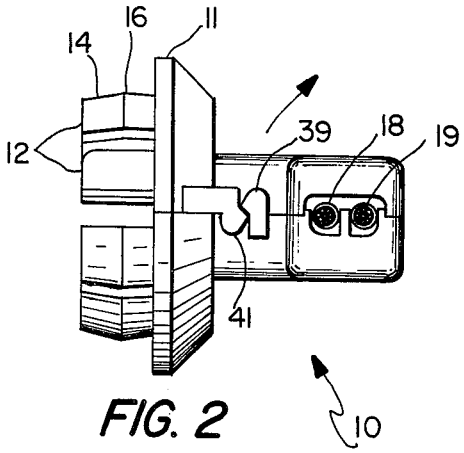
FIG. 2 is an end elevation of the socket of FIG. 1.

Referring first to FIGS. 1 and 2, it will be seen that the socket generally indicated at 10 superficially resembles sockets of the prior art and includes an annular flange 11 and forwardly protruding circularly spaced finger members 12 dimensioned to pass through an opening in a panel member shown in phantom lines at 13. The finger members are formed with an inwardly tapering forward portion 14 and an outwardly tapering rear portion 15, the forward portion being designed to have a minimum diameter smaller than the diameter of a preformed hole in panel 13 so that the finger members are radially inwardly distorted, slightly, until the portion of largest diameter at 16 passes through the opening, after which the finger members can radially expand to their former position to hold the forwardly facing shoulder of flange 11 against the back of panel 13. The body 17 of the socket is, in the embodiment shown, formed in an L shape so that the bulb to be inserted through the circular opening defined by fingers members 12 is perpendicular to electrical conductors 18 and 19 emerging from the opposite end of the socket body. It will be recognized, however, that this perpendicular relationship need not exist, and that a socket in accordance with the invention can be made in such a way that the conductors extend parallel with the direction of insertion of the bulb, or at some other angular relationship.

Figure 4:
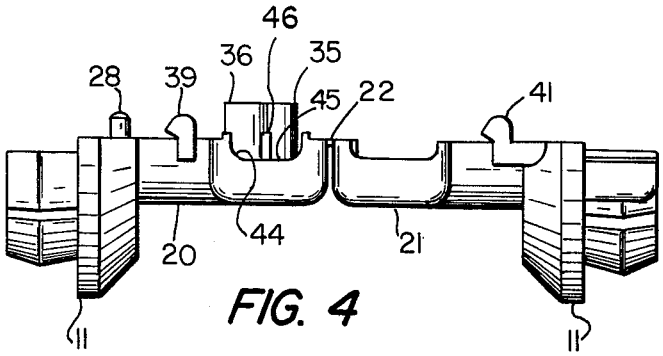
FIG. 4 is an end elevation of the socket of FIG. 3 in open position.
Figure 5:
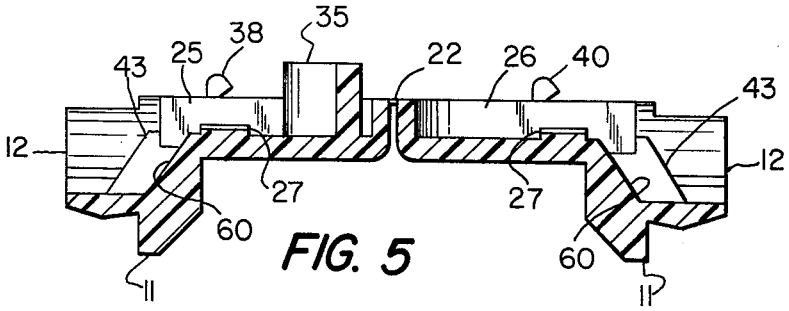
FIG. 5 is an end elevation in partial section along lines 5—5 of FIG. 3.

A major feature of the socket of the present invention is that it is made so that it consists of two halves which are similar, although not identical, to each other, the two halves being hinged together so that they can be moved between open and closed positions. The socket is shown in the open position in FIGS. 3-5, and will be seen to include first and second halves 20 and 21 each of which has formed thereon one-half of flange 11 and one-half of fingers 12. A web 22 extends between the two halves and forms a hinge permitting the described motion. Each of the halves is provided with means defining a generally L-shaped recess, half 20 having a recess 25 and half 21 having a recess 26. Each of these recesses is provided with a substantially identical pad 27 which protrudes into the recess and has a concave arcuate inner surface, this surface being provided to receive an enlargement at the base of the bulb to more accurately position the bulb. Pads 27 also serve to separate the attachhment clips, as will be described. It will be seen in FIG. 3 that each half has flat faces, which, in the closed position, are in paralell abutting relationship, half 20 also including alignment posts 28 which protrude from that surface and which are positioned to enter alignment holes 29 in the face of half 21 in the closed position.

Figure 3:
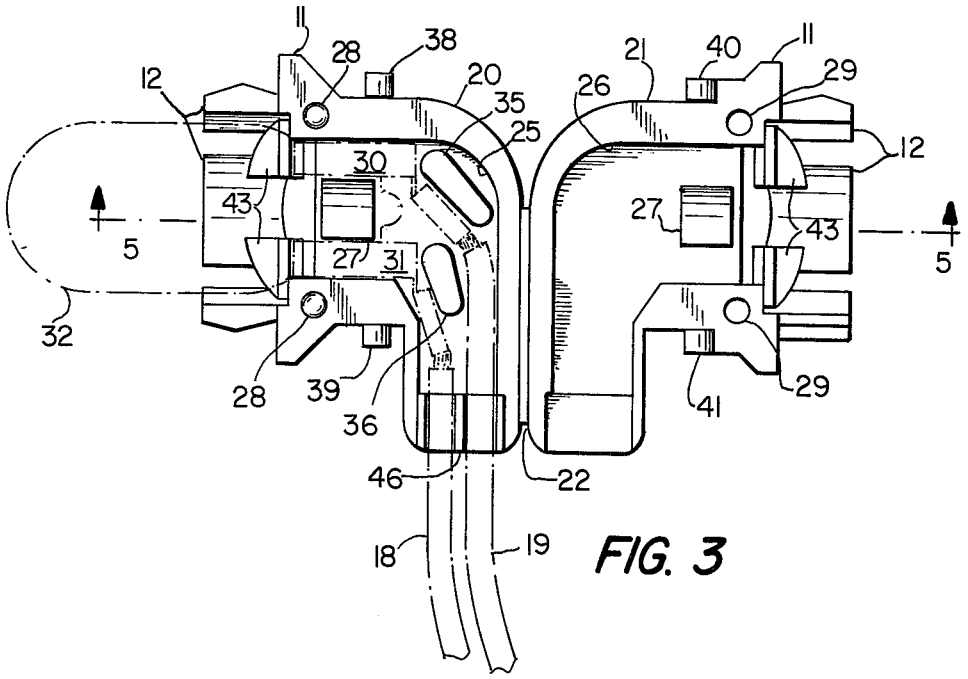
FIG. 3 is a side elevation of the socket of FIGS. 1 and 2 in open position.

The recesses 25 and 26 define, in the closed position of the socket, a channel which extends through the socket to receive, properly position, and contain clip members 30 and 31 which are shown in phantom lines in FIG. 3. The clip members are provided with integrally formed tab members frictionally engaging the stripped ends of insulated wires 18 and 19 which extend out of the socket. The bulb 32, also shown in phantom lines in FIG. 3 to permit illustration of the socket itself, is inserted into the end of the channel containing the clips to engage those clips and provide electrical contact with the conductors. Within recess 25 are post-like members 35 and 36 which protrude from the flat inner surface of recess 25 toward half 21 of the socket when the socket is in the closed position. The distal ends of posts 35 and 36 can be arranged to closely approach, or to contact, the inner surface of recess of 26 in that closed position.

Socket half 20 is also provided with latch members 38 and 39 which have hook-like sloping faces adapted to engage similar latch members 40 and 41 on socket half 21, the engagement of latch members 41 and 39 being visible in FIG. 2. Members 38 and 40 can be seen in FIG. 5. As will be observed, latch members 38 and 39 are spaced from flange 11 to permit members 40 and 41 respectively, to enter between the flange and the latch members for positive engagement thereof. Within the circular insertion opening defined by finger members 12 are molded elements having sloping surfaces 43 in each half of the sockets. These sloping surfaces slope toward each other when the socket is in the closed position and engage the bulbous portion of the bulb 32 when it is fully inserted to maintain the bulb in the desired position.

At the end of the socket through which conductors 18 and 19 extend, the recess is diminished in size and socket half 20 includes means defining a pair of generally U-shaped side-by-side openings 44 and 45 separated by an upstanding member 46 which serves to maintain the conductors in spaced parallel relationship and, in cooperation with half 21, to maintain the conductors in their desired position.

Figure 6:
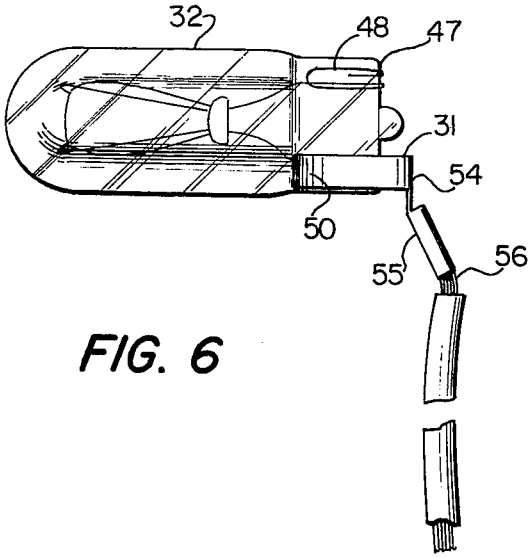
FIG. 6 is a side elevation of a bulb with a pre-assembled clip and wire assembly usable in the sockets of FIGS. 1-5.
Figure 7:
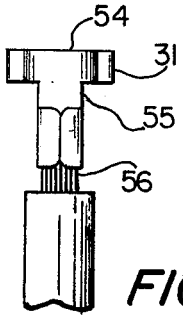
FIGS. 7 and 8 are end elevation and plan views, respectively, of the clip assembly shown in FIG. 6.
Figure 8:
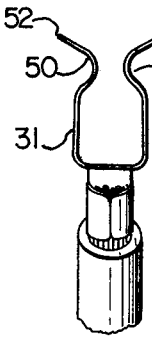

The bulb and the clip means are more clearly shown in FIGS. 6-8. The bulb itself, being conventional in nature, will not be described in detail, but it will be observed that bulb 32 in FIG. 6 includes electrical wires extending out of the base of the bulb at its end 47, the wires then being folded back over the exterior surface of the bulb at 48. The conductor on the opposite side of the bulb is folded back in a similar fashion either on the same side or on the opposite side of the bulb base. Which side the wires exist on is of no particular consequence.

A suitable clip for engaging the wires and making good, reliable electrical contact therewith is indicated at 31 in FIGS. 6-8, the clip being generally U-shaped in configuration but having indentations 50 and 51 and outwardly extending distal end portions 52 and 53 so that the bulb base can easily slide through between the indented portions, expand them slightly, and permit good engagement and electrical contact between the indented portions and the conductors 48. Each clip also has a flat base surface 54 from which extends an integrally formed metallic tab 55 with distortable portions which can be folded over and clamped against the stripped end portion 56 of a conductor to form good frictional engagement therewith and provide reliable electrical contact. This manner of connection is, of course, very common.

Referring again to the socket of FIG. 3, it will be seen that clip members 30 and 31 are maintained in substantially parallel spaced-apart relationship by pad 27 and also by the action of posts 35 and 36, post 36 lying between the connector portions 55 of the clips. While the posts and pads serve to locate and maintain these elements in their appropriate positions, it should be observed that the clips are not rigidly held and are not firmly engaged by the socket. Instead, they are floating to a degree, even when the socket is closed, until the bulb is inserted. Indeed, it will be observed from FIG. 5 that the socket is formed with outwardly sloping surfaces 60 at the locations which will be occupied by distal end portions 52 or 53 of the clip members to avoid placing any compressive force on these portions. Thus, at the time of manufacture of the clips exact spacing between the indentations 50 and 51 can be established and there is no force imposed by the socket itself on the clip portions tending to change that relationship. This permits the establishment and maintenance of a predetermined and reliably predictable insertion force which will exist when a bulb is inserted into the clips for the first time. The clips are, of course, produced from a springy material in the nature of phosphor bronze or the like for good electrical conductivity and appropriate spring action.

It will also be observed that post 35 serves to maintain clip 30 and its conductive exposed attachment portion properly located away from the corner of the L-shaped recess and that the forwardly facing surfaces (in the direction of the bulb) of posts 35 and 36 lie directly behind the flat rear surfaces 54 of the clips so that when the bulb is inserted the clips can move rearwardly very slightly and then abut the posts, thereby providing a force tending to hold the clips in position so that the bulb can be fully inserted.

Because of the fact that the side surfaces and configurations of the socket as illustrated herein are all straight or diverging surfaces, no undercuts and no complicated mold configurations are needed. Indeed, a simple one step molding operation is suitable to form the entire socket, the only separate operation being the formation of the clip and wire assemblies. These assemblies are then placed into the socket and the socket is snapped to the closed, latched position shown in FIGS. 1 and 2 and, with the insertion of a bulb, is a finished assembly ready for attachment to a wiring harness or installation in the location of desired use.

It will also be observed that any exposed electrically conductive portions are completely enclosed by the sockets and are exposed only in the direction of the bulb insertion. After insertion, all conductive portions are totally enclosed and unexposed. Because of the fact that the socket itself need not cooperate with the clips in any way to assist in completing the electrical contact with the base, the clips being in relatively loose floating relationship therein, the socket itself need not be made of a resilient material to the same degree as prior sockets in which clips were integrally molded. Indeed, the socket need only be of sufficiently resilient material so that fingers 12 can radially inwardly distort very slightly upon insertion of the socket into panel 13. This permits the use of polymeric materials such as a rigid polypropylene which resists cutting and abrasion and which has relatively high temperature characteristics, being able to withstand temperatures in excess of 200° C.

While one advantageous embodiment has been chosen to illustrate the invention it will be understood by those skilled in the art that various changes and modifications can be made therein without departing from the scope of the invention as defined in the appended claims.

What is claimed is:

1. A socket for releasably receiving a wedge base bulb of the type having an envelope and a pair of exposed conductors on the exterior of the base thereof and for also releasably receiving preassembled conductive wire and clip means, said socket comprising first and second socket halves molded from a rigid polymeric material;

a hinge member integrally formed with said socket halves and interconnecting said halves so that they can be relatively moved between an open position and a closed position;

each of said halves having means defining a recess extending between opposite ends thereof so that, when said halves are moved to said closed position, said recesses form a channel through the socket, one end of said channel being dimensioned to enclose said clip means and to receive the base of said bulb;

one of said halves having means at the other end of said channel for receiving a pair of wires and for maintaining said wires in spaced relationship;

said one of said halves having means in said recess intermediate the ends of said channel and extending toward the other one of said halves for maintaining said clip means in spaced relationship and in proper position when a bulb is inserted into said one end of said channel to engage said clip means; and latch means integrally formed on said halves for retaining said halves in said closed position;

and wherein said preassembled wire and clip means includes a pair of wires each having an exposed end portion, the remainder thereof being covered with an insulating material;

a pair of identical, generally U-shaped metal clip members each dimensioned to engage a conductor on the base of said bulb;

each of said members having integrally formed thereon a connector for frictionally and securely engaging said exposed end portion.

2. A socket according to claim 1 wherein each of said recesses is generally L-shaped, thereby forming an L-shaped channel when said socket is in said closed position;

and wherein said means for positioning said clip means includes first and second posts protruding inwardly into said channel from said one of said halves, said posts being located at the bend of said L-shaped channel, one of said posts being located to lie between the connectors on said clip members.

* * * * *